US008264214B1

(12) United States Patent
Ratnakumar et al.

(10) Patent No.: US 8,264,214 B1
(45) Date of Patent: Sep. 11, 2012

(54) VERY LOW VOLTAGE REFERENCE CIRCUIT

(75) Inventors: Albert Ratnakumar, San Jose, CA (US); Qi Xiang, San Jose, CA (US); Simardeep Maangat, San Jose, CA (US); Jun Liu, Milpitas, CA (US)

(73) Assignee: Altera Corporation, San Jose, CA (US)

( * ) Notice: Subject to any disclaimer, the term of this patent is extended or adjusted under 35 U.S.C. 154(b) by 0 days.

(21) Appl. No.: 13/051,648

(22) Filed: Mar. 18, 2011

(51) Int. Cl.
*G05F 3/16* (2006.01)

(52) U.S. Cl. ..... 323/314; 323/316

(58) Field of Classification Search ..... 323/313, 323/314, 316
See application file for complete search history.

(56) References Cited

U.S. PATENT DOCUMENTS

| | | | | |
|---|---|---|---|---|
| 3,975,648 | A * | 8/1976 | Tobey et al. | 327/543 |
| 5,229,711 | A * | 7/1993 | Inoue | 323/313 |
| 5,471,131 | A * | 11/1995 | King et al. | 323/314 |
| 5,530,394 | A * | 6/1996 | Blossfeld et al. | 327/530 |
| 5,610,550 | A * | 3/1997 | Furutani | 327/543 |
| 5,867,013 | A * | 2/1999 | Yu | 323/314 |
| 6,933,770 | B1 * | 8/2005 | Ranucci | 327/539 |
| 7,009,444 | B1 | 3/2006 | Scott | |
| 7,768,343 | B1 | 8/2010 | Sinitsky | |
| 2002/0079876 | A1 * | 6/2002 | Eguchi | 323/313 |
| 2005/0106765 | A1 | 5/2005 | King | |
| 2005/0231270 | A1 | 10/2005 | Washburn | |
| 2006/0197584 | A1 | 9/2006 | Hsu | |
| 2007/0080740 | A1 | 4/2007 | Berens | |
| 2008/0042737 | A1 | 2/2008 | Kim | |
| 2009/0001958 | A1 * | 1/2009 | Fujii | 323/313 |
| 2009/0189590 | A1 * | 7/2009 | Ide | 323/313 |

OTHER PUBLICATIONS

Lee, "The Design of CMOS Radio-Frequency Integrated Circuits" Cambridge University Press, 2nd Ed., 2004 pp. 318-326.

* cited by examiner

*Primary Examiner* — Jeffrey Sterrett
(74) *Attorney, Agent, or Firm* — Treyz Law Group; Chih-Yun Wu; G. Victor Treyz

(57) ABSTRACT

A low-voltage reference circuit may have a pair of semiconductor devices. Each semiconductor device may have an n-type semiconductor region, an n+ region in the n-type semiconductor region, a metal gate, and a gate insulator interposed between the metal gate and the n-type semiconductor region through which carriers tunnel. The metal gate may have a work function matching that of p-type polysilicon. The gate insulator may have a thickness of less than about 25 angstroms. The metal gate may form a first terminal for the semiconductor device and the n+ region and n-type semiconductor region may form a second terminal for the semiconductor device. The second terminals may be coupled to ground. A biasing circuit may use the first terminals to supply different currents to the semiconductor devices and may provide a corresponding reference output voltage at a value that is less than one volt.

20 Claims, 5 Drawing Sheets

VERY LOW VOLTAGE REFERENCE CIRCUIT

BACKGROUND

Integrated circuits often require voltage reference circuits. Reference circuits may be used to establish known voltage levels for controlling power supplies and other circuits. Ideally, reference circuits should exhibit good immunity to changes in process, voltage, and temperature (so-called PVT variations).

One popular type of reference circuit is the so-called bandgap reference circuit. Bandgap reference circuits exhibit stable behavior with respect to PVT variations, but are limited to producing output voltages at about 1.2 volts. Threshold-voltage-based complementary metal-oxide-semiconductor (CMOS) reference circuits have been developed that are capable of operating at lower output voltages, but this type of reference circuit tends to exhibit large amounts of process dependence, due to the dependence of threshold voltage on process (implant) variations.

SUMMARY

As power supply voltages in modern circuits are scaled to lower voltages, there is a need to produce reference circuits that operate at voltages below one volt. It would be therefore desirable to be able to provide improved integrated circuit voltage reference circuits.

A reference circuit may be provided that has a pair of semiconductor devices. Each semiconductor device may have an n-type semiconductor region, an n+ region in the n-type semiconductor region, a metal gate, and a gate insulator interposed between the metal gate and the n-type semiconductor region. The metal gate may have a work function that matches the work function of p-type polysilicon. The gate insulator may have a thickness of less than about 25 angstroms. The metal gate may form a first terminal for the semiconductor device and the n+ region may form a second terminal for the semiconductor device. The second terminals may be coupled to ground. When a voltage is applied across the first and second terminals, current may tunnel through the gate insulator and the semiconductor device may exhibit a turn-on voltage of between 0.3 and 0.5 volts.

The reference circuit may have a biasing circuit that is coupled to the first terminals of the semiconductor devices. During operation, the biasing circuit may supply different currents to the semiconductor devices and may provide a corresponding reference output voltage at an output terminal. The reference voltage may have a value that is less than one volt.

Further features of the invention, its nature and various advantages will be more apparent from the accompanying drawings and the following detailed description of the preferred embodiments.

DETAILED DESCRIPTION

Voltage reference circuits are commonly used in integrated circuit designs where a stable voltage of a known magnitude is required. For example, some integrated circuits have power supply circuitry in which the magnitude of the power supply voltage that is produced by the power supply circuitry is regulated using a bandgap reference circuit.

Figure 1:
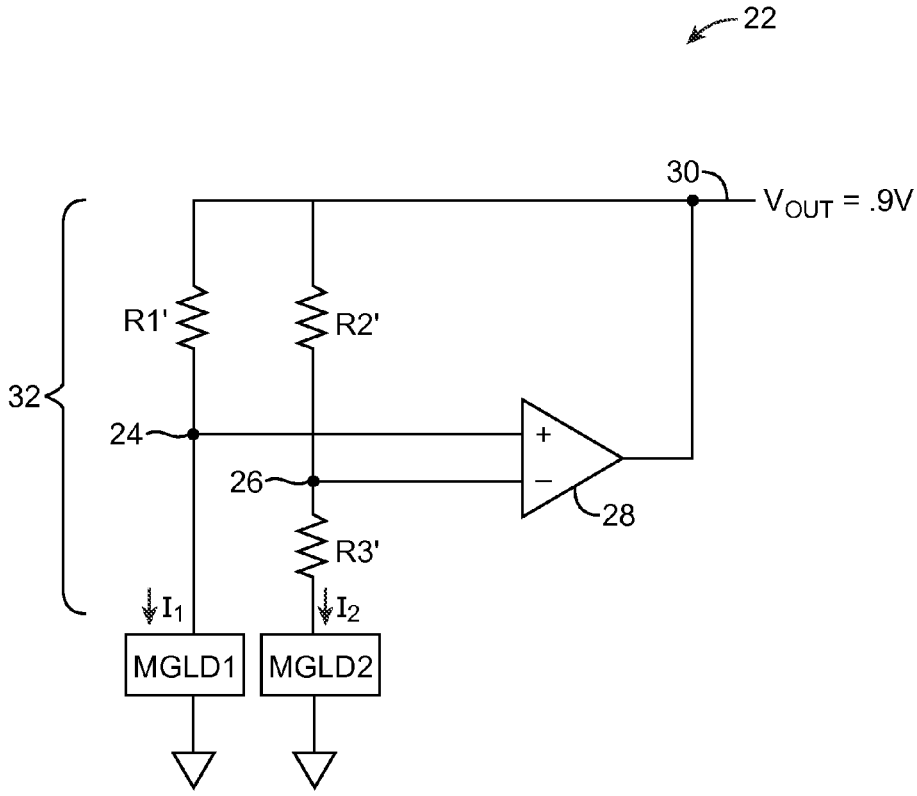
FIG. 1 is an exemplary diagram of a voltage reference circuit in accordance with an embodiment of the present invention.

FIG. 1 According to one embodiment of the present invention shown in FIG. 1, reference circuit 22 has a pair of semiconductor devices such as metal-gate leakage diodes MGLD1 and MGLD2 that are biased by biasing circuit 32. Biasing circuit 32 of low-voltage reference circuit 22 of FIG. 1 applies biasing signals to diodes MGLD1 and MGLD2. The values of resistors R1', R2', and R3' may be selected to ensure that appropriate different currents I1 and I2 flow through diodes MGLD1 and MGLD2. Resistors R1', R2', and R3' may, as an example, have respective resistances of 5 kilo-ohms, 6.7 kilo-ohms, and 1 kilo-ohms. With another suitable arrangement, R1', R2', and R3' may have respective resistances of 28 M-ohm, 83 M-ohm, and 67.5 M-ohm. Other resistance values may be used if desired. These illustrative resistance values for the resistors of biasing circuit 32 are merely presented as an example.

Biasing circuit 32 may have an operational amplifier such as operational amplifier 28. The positive input terminal of operational amplifier 28 may be coupled to node 24. The negative input terminal of operational amplifier 28 may be coupled to node 26. During operation, operational amplifier 28 provides a corresponding output voltage Vout on output terminal 30 while maintaining the voltages on nodes 24 and 26 at equal values.

Diode MGLD1 has an anode coupled to terminal 24 and a cathode coupled to ground. Diode MGLD2 has an anode coupled to terminal 26 and a cathode coupled to ground. In one embodiment, diodes MGLD1 and MGLD2 are formed from metal-gate leakage diode structures that exhibit a relatively low turn-on voltage. The turn-on voltage of diodes MGLD1 and MGLD2 is generally about 0.3 to 0.5 volts, as opposed to the 0.7 volt turn-on voltage associated with conventional p-n junction diodes of the type used in bandgap reference circuits. The low turn-on voltage of diodes MGLD1 and MGLD2 (e.g., 0.3 to 0.5 volts, 0.4 to 0.5 volts, less than 0.5 volts, etc.) allows reference circuit 22 to produce a voltage Vout on terminal 30 that is about 0.8 to 0.9 volts. This sub-one-volt reference signal may be used in circuits that require low-voltage references such as low-voltage power supply circuits and other circuits.

During operation, diode MGLD1 is characterized by a junction voltage of VGB1 and diode MGLD2 is characterized by a junction voltage of VGB2. Biasing circuit 32 and operational amplifier 28 hold the voltage at both nodes 24 and 26 at about VGB1. The resistor network made up of R1', R2', and R3' then ensures that the currents I1 and I2 have appropriate magnitudes (and I1/I2 has an appropriate non-unitary ratio) to set a desired value for $\Delta VGB = VGB1 - VGB2$. The value of ΔVGB is proportional to absolute temperature (PTAT), whereas the value of VGB1 is complementary to absolute temperature (CTAT).

Figure 2:
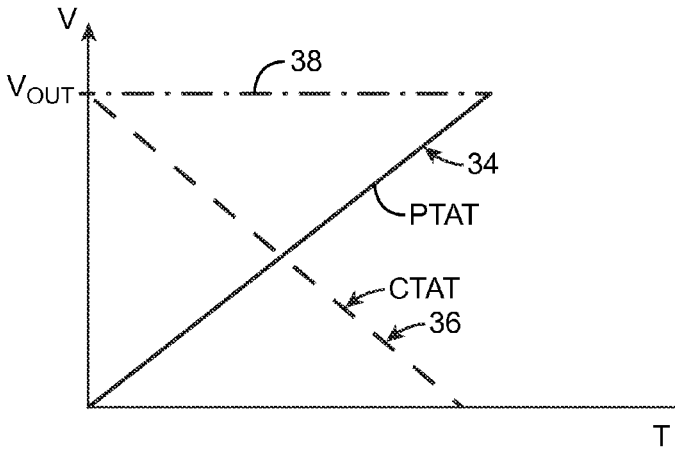
FIG. 2 is an exemplary graph associated with a voltage reference circuit FIG. 1 in accordance with an embodiment of the present invention.

The PTAT characteristic associated with ΔVGB (line 34 of FIG. 2) and the CTAT characteristic associated with VGB1 (line 36 of FIG. 2) tend to cancel each other out, as shown by reference output voltage Vout curve 38 of FIG. 2. As shown in FIG. 2, curve 38 tends to be flat over a wide range of temperature variations. Using a biasing circuit arrangement of the type shown in FIG. 1, the value of Vout is given by equation 1.

$$Vout=R2'/R3'(\Delta VGB1)+VGB1 \quad (1)$$

If desired, other biasing circuits may be used. The biasing circuitry that is used in the illustrative configuration of FIG. 1 is merely an example and not intended to limit the scope of the present invention.

Figure 3:
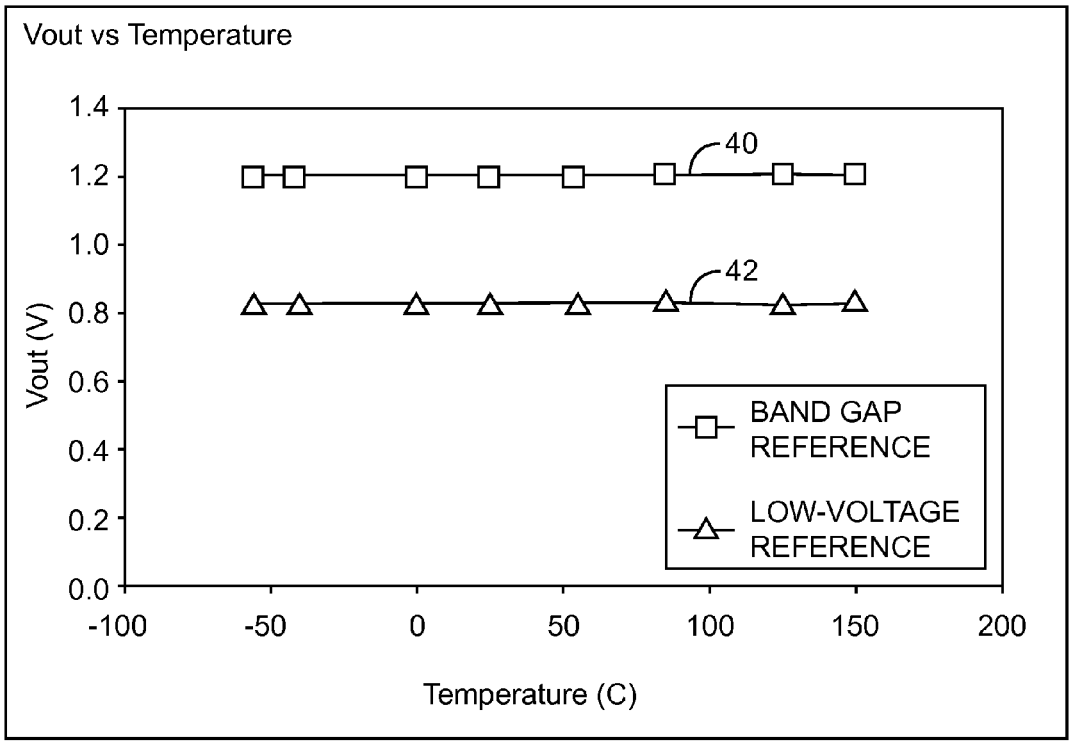
FIG. 3 is an exemplary graph comparing voltage output for a conventional bandgap reference circuit to a low-voltage reference circuit in accordance with an embodiment of the present invention.

The performance of low-voltage reference circuit 22 of FIG. 1 and that of a conventional bandgap reference circuit having diodes formed from bipolar junction transistor structures whose terminals have been connected to form p-n junction diodes may be compared by simulation. A graph of simulation results for a conventional bandgap reference circuit and a low-voltage reference circuit of the type shown in FIG. 1 is shown in FIG. 3. The output Vout of the conventional bandgap reference circuit is represented by line 40. The output Vout of low-voltage reference circuit 22 is represented by line 42. Both curve 40 and curve 42 are stable over a range of typical operating temperatures (e.g., from below −50° C. to about 150° C.), but, as shown by the lower magnitude of curve 42 when compared to that of curve 40, low-voltage reference circuit 22 is capable of producing a substantially lower reference output voltages than conventional bandgap references. In particular, low-voltage reference circuit 22 may produce an output voltage of about 0.83 volts compared to an output voltage of about 1.19 volts for a conventional bandgap reference circuit.

Figure 4:
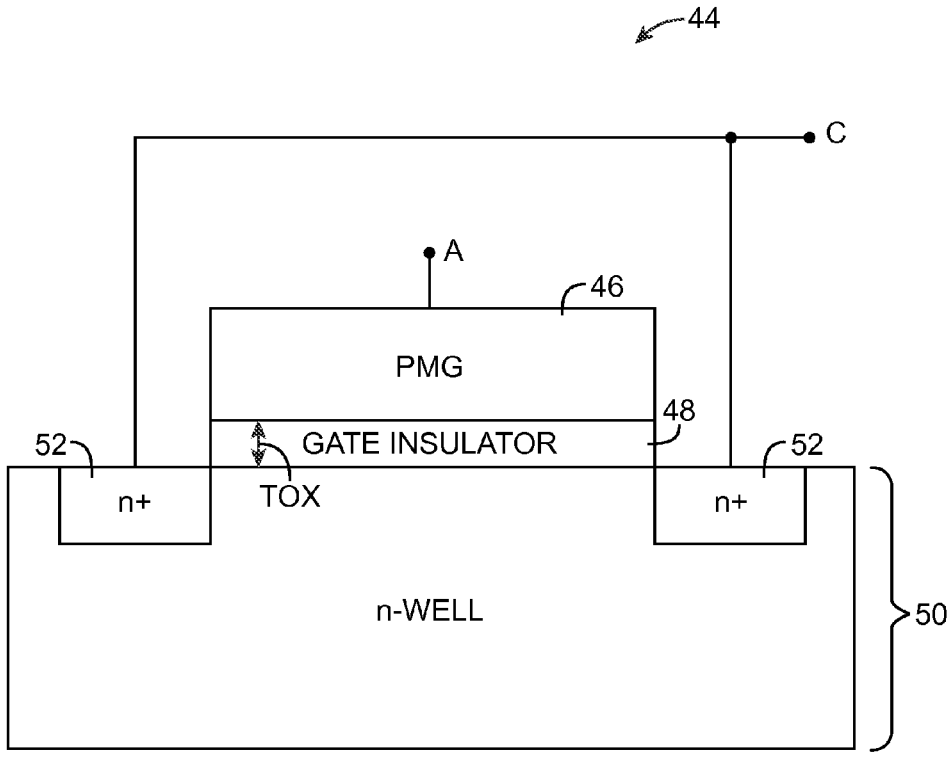
FIG. 4 is an exemplary cross-sectional side view of an illustrative metal-gate leakage diode used in a voltage reference circuit FIG. 1 in accordance with an embodiment of the present invention.

FIG. 4 is an exemplary cross-sectional side view of an illustrative metal-gate leakage diode of the type that may be used in implementing metal-gate leakage diodes MGLD1 and MGLD2 of FIG. 1. As shown in FIG. 4, metal-gate leakage diode 44 may be a two-terminal semiconductor device having an anode A and a cathode C. Anode A may be coupled to node 24 of circuit 22 of FIG. 1 (e.g., when the structures of metal-gate leakage diode 44 of FIG. 4 are being used to implement metal-gate leakage diode MGLD1 of FIG. 1) or node 26 of circuit 22 of FIG. 1 (e.g., when the structures of metal-gate leakage diode 44 are being used to implement metal-gate leakage diode MGLD2 of FIG. 1). Cathode C may be coupled to ground in circuit 22.

Metal-gate leakage diode 44 may be formed from a semiconductor substrate such as a silicon substrate. An n-type doped region such as n-well 50 may be formed in the silicon substrate. One or more heavily doped n+ regions 52 may be formed in n-well 50 (to form Ohmic contacts with the n-well) using ion implantation or other suitable doping techniques. The n+ regions are electrically connected to the n-well and therefore both the n-well and n+ regions form part of one of the terminals for diode 44 (i.e., its cathode). The n+ regions in cathode C may have associated metal contacts or other conductive terminal structures that are coupled to n+ regions 52 and that also form part of cathode C. As shown in FIG. 4, n+ regions 52 may be adjacent to the semiconductor that lies directly under gate insulator 48.

Gate insulator 48 may be formed on the surface of semiconductor substrate 50. Gate insulator 48 may be formed from a layer of dielectric such as silicon oxide, a hafnium-based oxide, other metal oxides, a nitride, oxynitrides, or other insulating materials. Quantum mechanical tunneling may allow current to pass through insulator 48 during operation of diode 44.

Conductive gate 46 may serve as anode terminal A. Conductive gate 46 is preferably formed from metal. If desired, conductive gate 46 may be formed from doped semiconductor. For example, conductive gate 46 may be formed from a p+ polysilicon layer when region 50 is an n-well. Such polysilicon-based gate structures are typically formed using self-aligned semiconductor fabrication processes and may involve an undesired amount of process complexity. Formation of gate 46 from metal, which generally avoids the need for self-aligned techniques, is therefore generally preferred.

In configurations in which gate conductor 46 is formed from metal, the work function of the metal is preferably chosen to approximately match that of p-type polysilicon. The work function of the metal may, for example, be within +/−0.5 eV of the work function of p-type polysilicon. This type of metal is depicted in FIG. 4 as p-type metal gate pMG. Other types of metal (e.g., a metal with a work function comparable to that of n-type polysilicon) and various combinations of the doping types for regions 50 and 52 are possible, but generally result in sub-optimal performance compared to the arrangement shown in FIG. 4 that uses a "p-metal" gate.

Figure 5:
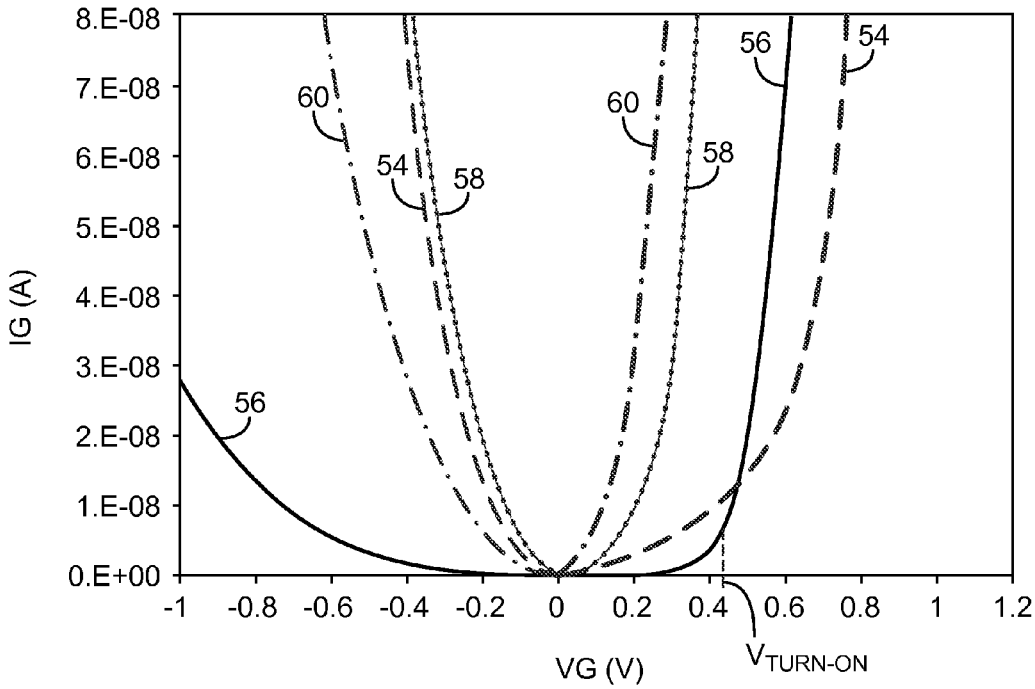
FIG. 5 is an exemplary graph of illustrative current versus voltage characteristics for various semiconductor structures FIG. 4 in accordance with an embodiment of the present invention.

FIG. 5 is an exemplary graph that compares the current-versus-voltage (IV) characteristics of various combinations of gate metals and semiconductor doping types for structures of the type shown in FIG. 4. Curve 60 corresponds to the IV characteristic of a normal varactor in which regions 52 have n+ doping, region 50 has n-type doping, and gate 46 is an "n-metal" gate (nMG) having a work function comparable to that of n-type polysilicon (e.g., about 4.2 eV). Curve 58 corresponds to the IV characteristic of a structure having n+ regions 52, a p-type region 50, and an n-metal gate. Curve 54 corresponds to the IV characteristic of a structure having n+ regions 52, a p-type region 50, and a p-metal gate (pMG) (i.e., a gate metal having a work function comparable to that of p-type polysilicon—e.g., 5.1 eV or in the range of 4.9 to 5.3 eV, 4.5 to 5.8 eV, etc.). The work function of p-metal gate pMG may, as an example, be about 0.3 eV below that of p+ polysilicon (e.g., the work function of gate pMG may be about 4.8 eV, 4.6 to 5.0 eV, 4.5 eV to 5.1 eV, 4.3 eV to 5.3 eV, etc.). An example of a material that may be used to form a p-metal gate is an alloy of titanium and aluminum. Elemental metals and other metal alloys may be used for forming p-metal gate (pMG) 46 if desired.

As shown in FIG. 5, the structures corresponding to curves 60, 58, and 54 do not exhibit highly diode-like behavior. Curve 56, which corresponds to the combination of structures shown in the labeled diagram of FIG. 4 (i.e., n+ structures 52, n-well 50, and p-metal gate 46), exhibits a sharp diode-like turn-on voltage at about 0.3 to 0.5 volts and exhibits minimal reverse bias current (i.e., Ig is relatively low for bias voltages Vg of less than 0 volts). The device structure of FIG. 4 therefore exhibits a highly diode-like operating characteristic and is suitable for use in a reference circuit. When formed using n+ doped regions 52, n-type doped region 50, and p-metal gate 46, the structures of FIG. 4 form a metal-gate leakage diode configuration suitable for use as devices MGLD1 and MGLD2 of voltage reference circuit 22 of FIG. 1.

The thickness of gate insulator 48 and the work function of gate conductor 46 may, if desired, be adjusted to adjust Vout and the amount of current that passes through diodes MGLD1 and MGLD2 (e.g., to produce a circuit configuration that exhibits reduced power consumption). With one suitable arrangement, the thickness TOX of insulator 52 may be about 13 angstroms (e.g., about 13 to 20 angstroms, less than 15 angstroms, less than 20 angstroms, about 13 to 25 angstroms, less than 25 angstroms, etc.). If desired, gate insulator 48 may be formed on an integrated circuit as part of a standard CMOS semiconductor fabrication process (e.g., when forming gate insulators for metal-oxide-semiconductor transistors elsewhere on the integrated circuit), thereby avoiding the need to include additional process steps (e.g., gate insulator removal steps) as part of the process of forming diodes MGLD1 and MGLD2.

At values of TOX below about 25 angstroms, the conduction mechanism in diodes MGLD1 and MGLD2 is believed to be by direct tunneling of carriers (electrons) between the n-wells of the diodes to their p-metal gates. The total current that tunnels through the gate insulator during operation of the diode includes a contribution from both the conduction band and the valence band. The structure used for diodes MGLD1 and MGLD2 resembles that of a p-metal gate varactor device having a gate insulator that is thin enough to permit quantum-mechanical tunneling of carriers and in which no current flow between the diode terminals is possible until the gate voltage on the p-metal gate is approximately equal to the flat-band voltage of the device (i.e., the turn-on voltage is approximately equal to the flat-band voltage VFB). With a metal gate, the magnitude of flat-band voltage VFB is typically smaller than that for a polysilicon gate (at 0K) and is smaller than the bandgap of silicon by about 0.3 volts. At values of TOX above about 25 angstroms, the conduction mechanism involves other mechanisms such as Fowler-Nordheim tunneling and does not generally result in a good diode-like characteristic of the type shown by curve 56 of FIG. 5. As described in connection with FIG. 5, devices with p-metal gates and n-wells are generally believed to be preferable to devices with n-metal gates and devices with p-metal-gates and p-wells.

The foregoing is merely illustrative of the principles of this invention and various modifications can be made by those skilled in the art without departing from the scope and spirit of the invention.

What is claimed is:

1. A reference circuit, comprising:

first and second diodes each of which has a gate, a doped semiconductor region, and a gate insulator layer interposed between the gate and the doped semiconductor region of the diode associated therewith, wherein the gate insulator is operable to allow carriers to tunnel between the doped semiconductor region and the gate of the diode associated therewith; and a biasing circuit coupled to the first and second diodes and having an output that is operable to supply a reference voltage.

2. The reference circuit defined in claim 1, wherein the gates of the first and second diodes comprise metal.

3. The reference circuit defined in claim 1, wherein the gate insulators of the first and second diodes each have a thickness of less than 20 angstroms.

4. The reference circuit defined in claim 1 further comprising a ground terminal coupled to the doped semiconductor regions.

5. The reference circuit defined in claim 1, wherein the doped semiconductor regions comprise n-type silicon.

6. The reference circuit defined in claim 5 further comprising n+ regions in the n-type silicon, wherein the metal gate of the first diode forms an anode for the first diode, wherein the metal gate of the second diode forms an anode for the second diode, and wherein the anodes are coupled to the biasing circuit.

7. The reference circuit defined in claim 6, wherein the first and second diodes are biased differently in response to biasing circuit changing an amount of current passing through the anodes.

8. The reference circuit defined in claim 7, wherein the gates of the first and second diodes comprise metal.

9. The reference circuit defined in claim 1, wherein the doped semiconductor regions of the first and second diodes comprise n-wells and the gates of the first and second diodes comprise metal, and wherein the first and second diodes further comprise n+ regions in the n-wells that are coupled to ground.

10. A reference circuit, comprising:

a pair of semiconductor devices, wherein each semiconductor device has a well region, a doped region within the well region, a gate conductor, and a gate insulator interposed between the well region and the gate conductor, wherein each semiconductor device is operable to allow carriers to tunnel between the well region and the gate conductor of the semiconductor device associated therewith; and a circuit operable to supply different biasing currents to the pair of semiconductor devices and to produce a corresponding reference output voltage.

11. The reference circuit defined in claim 10, wherein the diodes have associated turn-on voltages of less than 0.5 volts and wherein the circuit is operable to produce a reference output voltage of less than 1.0 volts.

12. The reference circuit defined in claim 10, wherein the well region of each semiconductor device comprises an n-well.

13. The reference circuit defined in claim 12, wherein the doped region of each semiconductor device comprises an n+ doped region in the n-well.

14. The reference circuit defined in claim 10, wherein the gate conductor of each semiconductor device comprises metal.

15. The reference circuit defined in claim 14, wherein the metal has a work function of 4.3 eV to 5.3 eV.

16. The reference circuit defined in claim 10, wherein each of the semiconductor devices comprises a first terminal coupled to the circuit and a second terminal coupled to ground, wherein the first terminal of each semiconductor device is formed by the gate conductor of that semiconductor device, and wherein the second terminal of each semiconductor device includes the doped region and the well region of that semiconductor device.

17. A voltage reference circuit, comprising:

a first semiconductor device having an n-type semiconductor region, at least one n+ region in the n-type semiconductor region, a metal gate, and a gate insulator layer interposed between the metal gate and the n-type semiconductor region, wherein the gate insulator layer of the first semiconductor device is operable to allow carriers to tunnel between the n-type semiconductor region and the metal gate; and a second semiconductor device having an n-type semiconductor region, at least one n+ region in the n-type semiconductor region, a metal gate, and a gate insulator layer interposed between the metal gate and the n-type semiconductor region, wherein the gate insulator layer of the second semiconductor device is operable to allow carriers to tunnel between the n-type semiconductor region and the metal gate; and circuitry coupled to the first and second semiconductor devices and operable to produce a reference output voltage using the first and second semiconductor devices.

18. The voltage reference circuit defined in claim 17, wherein the circuitry is coupled to the metal gates and is operable to apply different signals to the first and second semiconductor devices.

19. The voltage reference circuit defined in claim 17, wherein the circuitry comprises an operational amplifier with an output operable to produce the reference output voltage and wherein the circuitry is operable to apply different currents to the first and second semiconductor devices through the metal gates, the voltage reference circuit further comprising a ground terminal coupled to the n+ regions.

20. The voltage reference circuit defined in claim 17, wherein the first and second semiconductor devices have turn-on voltages of less than 0.5 volts and wherein the circuitry is operable to produce the reference output voltage at a magnitude of less than one volt.

* * * * *